US011717944B2

(12) United States Patent
Barberan Latorre

(10) Patent No.: US 11,717,944 B2
(45) Date of Patent: Aug. 8, 2023

(54) VACUUM SYSTEM FOR SECURING SUBSTRATES

(71) Applicant: Jesus Francisco Barberan Latorre, Castelldefels (ES)

(72) Inventor: Jesus Francisco Barberan Latorre, Castelldefels (ES)

( * ) Notice: Subject to any disclaimer, the term of this patent is extended or adjusted under 35 U.S.C. 154(b) by 0 days.

(21) Appl. No.: 17/098,881

(22) Filed: Nov. 16, 2020

(65) Prior Publication Data

US 2021/0154802 A1 May 27, 2021

(30) Foreign Application Priority Data

Nov. 21, 2019 (EP) ..... 19383028

(51) Int. Cl.
*B25B 11/00* (2006.01)

(52) U.S. Cl.
CPC ..... *B25B 11/005* (2013.01)

(58) Field of Classification Search
CPC ..... B25B 11/00; B25B 11/005; B65H 5/224; B65H 11/005; B65H 2406/32; B65H 2406/41; B65H 2406/362; B65H 2406/3622; B65H 2406/3632; B65H 2406/366; B41J 11/003; B41J 11/007; B41J 11/0085; B41J 2/01; B41J 2/14; B65G 15/58
USPC ..... 269/21, 20, 289
See application file for complete search history.

(56) References Cited

U.S. PATENT DOCUMENTS

| | | | | |
|---|---|---|---|---|
| 2,969,869 A * | 1/1961 | Klingler | B65H 29/32 198/689.1 |
| 4,792,249 A * | 12/1988 | Lahr | B41J 11/007 271/197 |
| 7,980,558 B2 | 7/2011 | Moore et al. | |
| 8,308,287 B2 | 11/2012 | Ebihara | |
| 8,353,591 B2 * | 1/2013 | Isowa | B31B 50/88 347/101 |
| 10,358,307 B1 * | 7/2019 | Liu | B41J 13/08 |

FOREIGN PATENT DOCUMENTS

| | | | |
|---|---|---|---|
| EP | 1892204 A1 * | 2/2008 | B65G 15/58 |
| EP | 2022740 A2 * | 2/2009 | B65H 5/224 |
| JP | H07206124 A * | 8/1995 | B65G 17/46 |
| JP | 2009280320 A * | 12/2009 | |

* cited by examiner

*Primary Examiner* — Seahee Hong
(74) *Attorney, Agent, or Firm* — Lucas & Mercanti, LLP

(57) ABSTRACT

A vacuum system for securing substrates is provided, having a suction line, the conveyor belt configured to receive and transport at least one substrate, wherein the conveyor belt is provided with a plurality of perforations, wherein the vacuum system is configured to produce fluid suction through the perforations towards the interior of the suction line, generating a securing force of the at least one substrate to the conveyor belt. The invention is characterized in that each perforation is equipped with a valve which allows the opening and closing of the perforation, allowing and impeding, respectively, the passage of a fluid flow through the perforation.

13 Claims, 6 Drawing Sheets

VACUUM SYSTEM FOR SECURING SUBSTRATES

CROSS REFERENCE TO RELATED APPLICATION

This application claims the benefit of priority of European Patent Application No. 19383028.8, filed on Nov. 21, 2019, which is incorporated herein by reference.

TECHNICAL FIELD

The object of the present invention is a vacuum system for securing substrates, for example laminar substrates, in particular strips, grills, sheets, plates, panels, etc. on a conveyor belt.

The vacuum system for securing substrates on a conveyor belt object of the present invention has the particularity of allowing significant energy savings with respect to other conveyor belt vacuum transport systems.

Likewise, by means of the vacuum system for securing substrates on a conveyor belt object of the present invention, stronger securing of the substrates transported on the conveyor belt is enabled, which results in greater reliability when carrying out specific operations on said transported substrates, operations such as printing on said substrates while they are displaced on the conveyor belt.

BACKGROUND OF THE INVENTION

The transport systems by means of conveyor belts allow for the transport of pieces suspended from or supported on said conveyor belts.

Vacuum transport systems are based on applying a vacuum to achieve the adherence of the pieces to the conveyor belts. Vacuum transport systems are used in specific cases in which the mechanical securing of the pieces to be transported involves certain drawbacks (deterioration of the pieces to be transported, losses of time in transport processes, cost of the securing means, etc.) and where the magnetic securing is also not viable due to the pieces to be transported not being made of magnetic materials.

One particular case where vacuum transport on conveyor belts is used is in the cardboard sign or box manufacturing industry, wherein the grills should be deposited and transported with ease and agility by means of conveyor belts.

It is normal for the transport process of said substrates to be utilised for carrying out any task on the substrates, such as printing or labelling on the same.

In this printing task on a substrate which is moving on a conveyor belt, it is quite important for the piece or substrate to not experience sudden displacements with respect to the conveyor belt on which it is being displaced since said sudden displacements could cause inaccuracies or errors in the end result of the printing on the substrate. For this reason, it is very important to ensure suitable strength in the securing of the substrate to the conveyor belt to prevent relative displacements between substrate/strip and conveyor belt and thus ensure a good final result of the task to be carried out (for example, printing) on the substrate.

In other conventional vacuum transport systems by means of conveyor belt, said strength is not ensured since the suction or absorption (by vacuum) strength which is transmitted to the substrate through the holes of the conveyor belt is irregular and experiences variations as a function of the number of holes of the conveyor belt which at any given moment are blocked or obstructed by the substrates.

At the same time, another problem encountered with the vacuum transport systems by means of conveyor belt is its high energy loss (energy underutilisation) due to the fact that a large proportion of the absorption power is lost through holes of the conveyor belt on which no substrate/strip is situated.

The vacuum transport systems by means of conveyor belt usually comprise a perforated conveyor belt which moves forwards supported and rubbing on flat perforated metal grills. Said perforated grills are the upper closure of chambers or lines which (except for some residual losses) are leak-tight on the rest of their surfaces. Air suction which circulates through the perforations of these grills and in turn through the perforations of the conveyor belt is generated by means of, for example, fans with radial impellers.

In order to try to resolve the problem of energy underutilisation mentioned above, in some vacuum transport systems by means of conveyor belt, the suction chambers/lines are adjustable in width by means of moving vertical lateral closing plates; thus, the air flow through the perforations of the conveyor belt is also adjusted in width as necessary (for example, according to the width of the substrates to be transported). However, and despite adjusting the width of the suction line, there are still perforations in the sheet and the conveyor belt through which energy is lost (as they are not covered by any substrate to be transported), suction force consequently being lost in the perforations which are covered by the substrate to be transported.

In order to understand the foregoing, it is convenient to take into account the different forms in which the substrates are supplied to the conveyor belt. The most common forms are:

- Delivery of single substrate (see FIG. 2*a*): One substrate is delivered after another, with a specific gap between one substrate and the next one (the separation gaps between substrates/strips are not always the same). It is ensured that this gap is as small as possible.
- Delivery of a double paired substrate (see FIG. 2*b*): Two substrates are delivered in parallel and then another two and so on successively, leaving a gap between one delivery and the next one, the same as in the previous case.
- Delivery of an unpaired substrate (see FIG. 2*c*): Two substrates are delivered which are parallel to one another, but which do not coincide in their longitudinal alignment. They have a longitudinal divergence instead.

When a width-adjustable suction line is provided, the suction is laterally adjusted, in any of the cases.

Generally, the central area of the conveyor belt does not have perforations. In this way, according to the methods of double supply of the substrates, there is no suctioned air flow in the central area. However, in the direction of travel, in the gaps/perforations which are between the substrates, there are some perforations of the conveyor belt not covered by said substrates (there are more perforations not covered in the case of double unpaired supply/delivery).

As has already been introduced, the problem appears precisely due to the fact that when substrates are normally transported on the conveyor belt, there are always perforations not covered through which suction air flow circulates. Said suction air flow generates undesired effects of a different nature as a function of the use which is given to this transport. For example, if this transport forms part of a printing machine by means of ink injection heads, air flow is produced in the area of the printing heads and when it is printing, undesired or uncontrollable effects are produced. Said problems are, amongst others, the following:

- Turbulences are produced which are translated into print defects in the limit areas of the substrates (lack of ink, smudged, blurred printing, etc.);
- Part of the ink injected in limit areas of the substrates is pulled by the suction airflow and causes soiling by deposition on the conveyor belt, on the perforated metal grills, in the suction lines and in general in the circuit through which the suction air circulates.

Additionally, as already set out, this "unused" suction air flow is translated into energy losses since maintaining this unnecessary air velocity requires energy corresponding to the fan moving this air, etc.

In addition, in any application where it is required that is no suctioning of the fluid situated above the conveyor belt is to take place, problems may occur. For example, in some curing processes by means of UV technologies it is known that displacing oxygen to increase efficiency by means of a nitrogen-type inert gas is common. If there is a chamber where nitrogen is injected and it is suctioned through the free perforations of the conveyor belt, significant losses are generated. Moreover, when this type of transport is used with a hot air drying tunnel above it, if the hot air is suctioned, energy losses are produced.

SUMMARY OF THE INVENTION

With the object of solving the previously mentioned drawbacks, the present invention relates to a vacuum system for securing substrates on a conveyor belt.

The vacuum system for securing substrates on a conveyor belt comprises a suction line and a conveyor belt configured to receive and transport at least one substrate.

The vacuum system (comprising the suction line and the conveyor belt) is preferably applied to a system for printing on the substrates.

The conveyor belt is provided with a plurality of perforations.

The vacuum system is configured to produce fluid suction (typically air, although it could be another fluid of the working environment) through perforations of the conveyor belt, towards the interior of the suction line, thus generating a securing force of the at least one substrate to the conveyor belt.

In a novel manner, each perforation of the conveyor belt is equipped with a valve which allows the opening and closing of said perforation, allowing and impeding, respectively, the passage of a fluid flow through said perforation.

In this way, when no substrate/strip/sheet/grill is supported on a perforation of the conveyor belt, the closing of the corresponding valve can be enabled, thus minimising energy losses as suction force is not underutilised through a perforation of the conveyor belt on which no substrate is supported.

The securing power and strength is also thus increased in the perforations of the conveyor belt on which a substrate is present.

Additionally, the regularity and homogeneity of the securing strength exerted through each perforation is increased and other problems of soiling deterioration in the quality of the work to be carried out on the substrate are avoided.

The system preferably comprises at least one support partition (20) to guide and support the conveyor belt in its displacement. Said support partitions (20) can be arranged forming at least one suction chamber which connects the suction of fluid between the conveyor belt and the suction line. In this way, the interior space of the suction line is utilized.

The system more preferably comprises a perforated plate, provided with perforations, arranged for the passage of the suction fluid therethrough between the conveyor belt and the suction line. The perforated plate can be arranged, where appropriate, between the suction chambers and the suction line. This configuration contributes to distributing the suction flow between the different suction areas corresponding to each suction chamber. In this case, the suction line communicates with said suction chambers, the chambers being closed at the bottom by the perforated plate (except for the perforations of the perforated plate which allow the passage of the suction flow). The at least one suction chamber is thus an upper area of the suction line, situated immediately below the conveyor belt.

The suction line (and/or the at least one suction chamber) preferably comprises at least one valve opening device along at least one area of the suction line (and/or along an area of the at least one suction chamber). This valve opening device is configured to force an open position of the valves.

Owing to the feature mentioned in the previous paragraph, it is ensured that all the valves of the perforations of the conveyor belt remain open in said area. Said area preferably corresponds to an initial area or reception or deposition area of the substrates on the conveyor belt. As it is ensured that the valves are open in said initial area, it means that the valves corresponding to the perforations of the conveyor belt on which the substrates are positioned are not closed when positioning the substrates in the initial area, to thus allow the passage through the perforations of the suction flow and initiate the securing of the substrates to the conveyor belt.

With the mentioned feature, it is also possible to selectively provide a suitable degree of blocking of the perforations in respective different areas, for example in the initial area or in an area adapted for printing. In particular, in the initial area, it is possible to suitably place the substrates and be able to adjust their position on top of the conveyor belt with relative ease. It must be taken into account that, once the valves corresponding to the perforations of the conveyor belt on which there is no substrate/strip are closed, the fastening power of the perforations over which there are substrates/strips increases; consequently, it would be much more difficult to correct an unsuitable position of the substrate if some valves of the initial area were closed. In addition, in an inkjet printing area, printing defect problems caused by the influence of the suction flow when ejecting the printing ink can be reduced or avoided.

According to a possible embodiment of the vacuum system, the opening device is a cam configured to produce a pushing force on projections of the valves, thus forcing the open position of the valves. This allows for simple construction in terms of the assembly and functioning of the valve opening device.

According to other possible alternative embodiments, the opening device can comprise a magnetic device or another element which generates a force that pushes the valves towards an open position.

According to a possible embodiment of the vacuum system, the valves comprise at least one auto-close mechanism configured to allow closing of the valve when there is no substrate situated over the corresponding perforation of the conveyor belt.

The previous feature allows the valves to close automatically (without the need for an actuation or an express command to close the valves) when there is no substrate positioned over the perforations of the conveyor belt.

The configuration of the auto-close mechanism enabling the closing of the valve comprises, according to one possible embodiment, a guide enabling the free movement of the valve, such that when there is no substrate arranged over the corresponding perforation of the conveyor belt, the valve is moved by the guide and is closed by the effect of the suction force itself of the vacuum system. This allows for simple configuration in terms of the assembly and functioning of the auto-close mechanism.

According to one possible embodiment, the configuration of the auto-close mechanism enabling the closing of the valve comprises at least one spring which forces an open and/or closed position of the valve. This feature can be introduced to increase the forcing effect or tendency of the valve to occupy a specific position (open or closed).

As an alternative to the auto-close mechanism, according to a possible embodiment of the vacuum system of the invention, the valves comprise at least one commanded close mechanism configured to close the valve when there is no substrate situated over the corresponding perforation of the conveyor belt. This allows the time, the circumstances and the valves on which the closing action is applied to be controlled more precisely.

According to the embodiment of the vacuum system according to which the valves comprise at least one commanded close mechanism, the vacuum system comprises a subsystem to detect the position of at least one substrate on the conveyor belt. This detection subsystem is configured to send instructions indicative of the positioning of the at least one substrate to the commanded close mechanism to close valves in a plurality of perforations of the conveyor belt on which no substrate is arranged. In this way, the vacuum system knows the areas or sections where there are no substrates on the conveyor belt so that the commanded close mechanism can activate the closing of the valves of those perforations on which no substrate is arranged.

According to a first embodiment of the commanded close mechanism, the commanded close mechanism is arranged covering the entire width of the conveyor belt along at least one specific longitudinal section of the conveyor belt, such that the commanded close mechanism is configured to close all the valves in said at least one specific longitudinal section of the conveyor belt and over the entire width of the conveyor belt, before receiving instructions from the detection subsystem.

The perforations of the conveyor belt can be arranged according to longitudinal alignments in the direction of travel of the conveyor belt. Said longitudinal alignments are distributed along the width of the conveyor belt.

According to a second embodiment of the commanded close mechanism, there is an independent commanded close mechanism in correspondence with each longitudinal alignment of the perforations of the conveyor belt and where each commanded close mechanism houses at least one longitudinal section of its corresponding longitudinal alignment of perforations of the conveyor belt.

The two embodiments described for the commanded close mechanism allow different forms of control of the securing force and of the sections and areas where the closing action is applied to the valves of the perforations of the conveyor belt.

According to one possible embodiment, each commanded close mechanism is configured to produce the closing of valves for a predetermined time interval.

Also according to one possible embodiment, the configuration of the commanded close mechanism enabling the closing of each valve comprises at least one spring which forces an open and/or closed position of the valve.

According to a possible embodiment, the vacuum system for securing substrates on a conveyor belt comprises a suction width regulating subsystem. This subsystem in turn comprises at least one displaceable lateral plate which laterally limits the suction line. The suction width regulating subsystem is configured to adjust the width of the suction line by means of displacing the at least one displaceable lateral plate. By means of this feature, the width of the conveyor belt over which a suction/securing force of the substrates is to be applied can be adjusted, and said application width of the securing force can be adjusted to the width occupied by the substrates on the conveyor belt.

BRIEF DESCRIPTION OF THE DRAWINGS

As part of the explanation of at least one embodiment of the invention, the following figures have been included.

DETAILED DESCRIPTION OF THE INVENTION

The present invention relates, as previously mentioned, to a vacuum system for securing substrates (1) on a conveyor belt (2).

Figure 1:
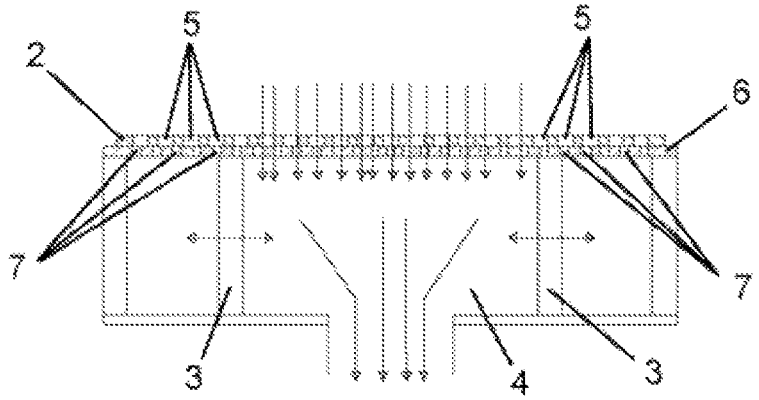
FIG. 1: Shows a transversal sectional view of a vacuum transport system by means of conveyor belt according to the state of the art, with the width of the suction channel being adjustable.

In said FIG. 1, the transport system is shown formed by the conveyor belt (2) with its perforations (5), the upper sheet or perforated grill (6) of the suction line (4) with its perforations (7), the suction line (4) itself, with the air flow through the perforations (5, 7) and the displaceable lateral plates (3) being represented by means of arrows.

FIG. 1 shows a transversal section of said conventional transport system. Therefore, the direction of displacement of the substrates (1) (not represented) is perpendicular to the section shown in FIG. 1.

According to a possible embodiment of the invention, the vacuum system for securing substrates (1) on a conveyor belt (2) object of the present invention can also incorporate this conventional system of displaceable lateral plates (3) constituting the sides of the suction channel or line (4), as occurs in the transport system of the state of the art shown in FIG. 1.

Figure 2A:
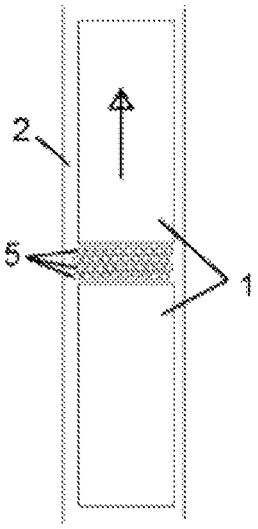
FIG. 2*a*: Shows an exemplary supply or delivery of a single substrate.
Figure 2B:
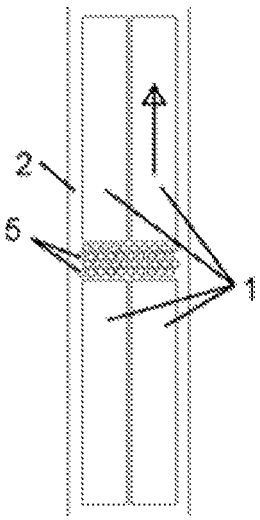
FIG. 2*b*: Shows an exemplary supply or delivery of a double paired substrate.
Figure 2C:
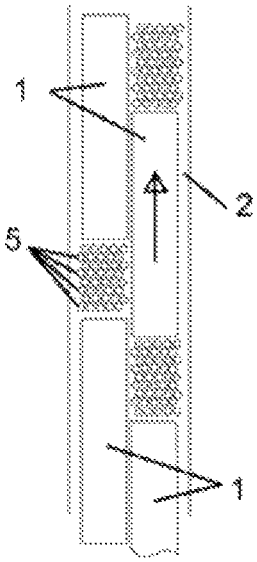
FIG. 2*c*: Shows an exemplary supply or delivery of a double unpaired substrate.

FIG. 2*a*, FIG. 2*b* and FIG. 2*c* in turn show the different forms of supply described in the previous section, according to which the substrates (1) are supplied or delivered to the conveyor belt (2).

According to the present invention, each perforation (5) of the conveyor belt (2) comprises an insert or valve (8) which allows a perforation (5) to be disabled (closed) when there is no substrate (1) arranged over said perforation (5). In this way, when there is no substrate (1) to be transported arranged over a perforation (5) of the conveyor belt (2), said valve (8) is closed, consequently no suction force is exerted through said perforation (5).

Figure 3:
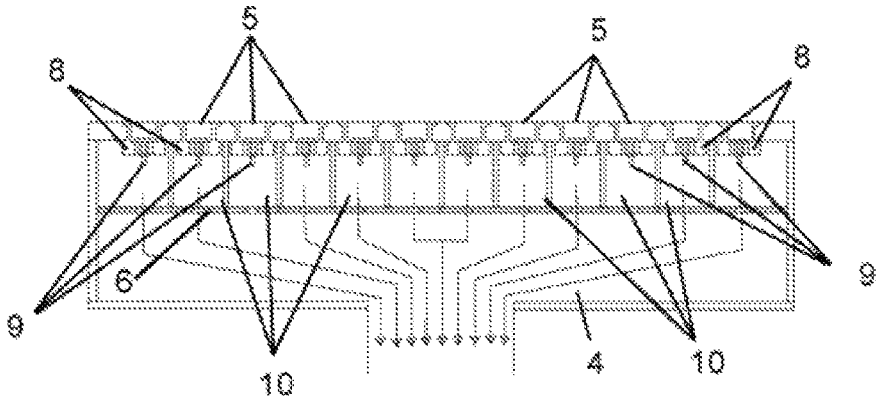
FIG. 3: Shows a transversal sectional view of an exemplary embodiment of the vacuum system for securing substrates on a conveyor belt, according to the present invention.

Therefore, the valves (8) have the task of opening or closing the passage of suction air therethrough. Said valves (8) or inserts in this embodiment comprise projections (9) which are projected outside of the conveyor belt (2), below it, such that they occupy a space below the conveyor belt (2), as is shown in FIG. 3.

The suction line (4) preferably connects to a series of suction chambers (10) situated immediately below the conveyor belt (2).

The suction chambers (10) have a longitudinally "open" design (in the direction of travel of the conveyor belt (2)) such that they allow the passage of the lower projections (9) of the valves (8) of the perforations (5) of the conveyor belt (2).

Similarly, the rollers (11) involved in the movement of the conveyor belt (2) comprise housings (holes, hollows or grooves) which allow the movement of the conveyor belt (2) without there being interference of the lower projections (9) of the valves (8) with said rollers (11).

Figure 4:
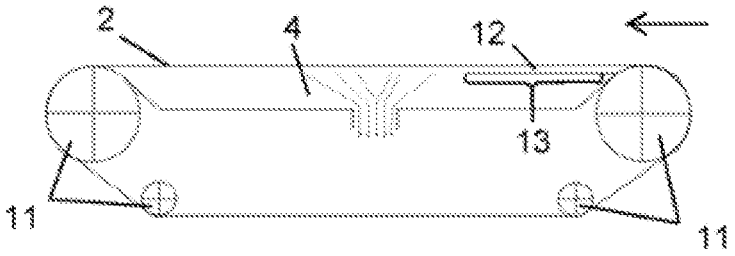
FIG. 4: Shows a schematic lateral view of the route of the conveyor belt, with the opening device existing in an initial area of the suction chambers being discernible.

Additionally, the suction chambers (10) preferably have a design incorporating at least one opening device (12) (see FIG. 4) which forces an open position of the valves (8) and which keeps them open in an initial area (13), in correspondence with the area where the supply of the substrates (1) to the conveyor belt (2) is produced; this area (13) of the suction chambers (10), in which the opening device (12) is situated, is extended for a sufficient length to ensure that the substrates (1) are fixed to the conveyor belt (2), maintaining the valves (8) in an open position such that it is ensured that the suction air flow circulates through the valves (8) in said area (13). Said at least one opening device (12) can be one or several longitudinal cams.

Figure 5:
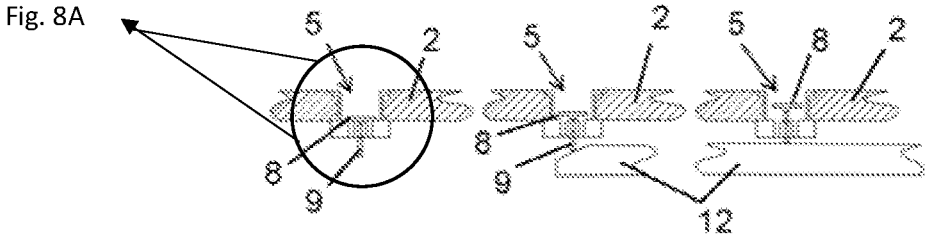
FIG. 5: Shows a detail of the passage of the conveyor belt through an initial area of one of the suction chambers, with the perforations of the conveyor belt not being occluded by any substrate.
Figure 6:
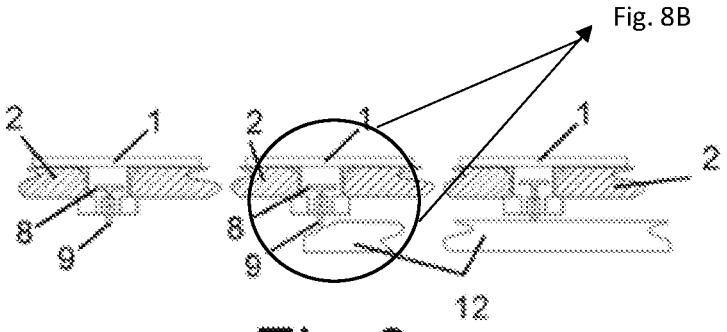
FIG. 6: Shows a detail of the passage of the conveyor belt through the initial area of one of the suction chambers, with the perforations of the conveyor belt being occluded by one or several substrates.

That is to say, when the conveyor belt (2) passes through this area (13), all the valves (8) remain in the open position (see FIG. 5 and FIG. 6); in this situation, the perforations (5) of the conveyor belt (2) are only closed (see FIG. 6) by the substrates (1) themselves (the perforations (5) which coincide below the substrates (1)).

Passing this initial area (13), the control of the valves (8) is preferably carried out according to two possible configurations or mechanisms of the valves (8):

Valve (8) with "auto-close" due to the vacuum itself ("non-forced closing"), and;

Valve (8) with commanded closing ("forced closing").

In the case of the valves (8) with auto-close mechanism, once the initial area (13) of the suction chambers (10) is passed, the valves (8) of each perforation (5) of the conveyor belt are mechanically released and then the valves (8) situated on the perforations (5) where there is no substrate (1) are closed by the effect of the suction itself to keep them like this for the rest of the journey of the conveyor belt (2) until the return of the conveyor belt (2) through the part below the suction line (return journey of the conveyor belt (2) to the initial area (13) of the suction chambers (10)).

When the valves (8) cross the redirection rollers (11) (tensor roller of the conveyor belt (2)), the cycle begin again.

In this way, after the area (13) in which the strong securing of the substrates (1) to the conveyor belt (2) is produced, an empty space is achieved without flow circulating through the perforations (5) of conveyor belt (2) where there is no substrate (1).

That is to say, in the perforations (5) on which no substrate (1) is situated, when the conveyor belt (2) leaves the area (13), the valve (8) is closed by the effect of the suction itself.

On the contrary, in the perforations (5) of the conveyor belt (2) on which a substrate (1) is situated, the valve (8) is still not closed when the conveyor belt (2) leaves the area (13), even though the opening device (12) situated in said area (13) of each suction chamber (10) has finished. In the perforations (5) of the conveyor belt (2) on which the substrate (1) is situated, the suction force itself fixes the substrate (1) to the conveyor belt (2).

In the case of providing valves (8) with a commanded close mechanism ("forced closing"), it is necessary for the vacuum system of the invention to incorporate a detection subsystem (not represented in the figures) which allows the position of the substrates (1) on the conveyor belt (2) to be detected. This detection subsystem is configured to send instructions to each close mechanism of the valves (8), to select their opening or closing depending respectively on whether or not there is a substrate (1) situated over each perforation (5) of the conveyor belt (2).

In turn, within this embodiment in which the valves (8) are provided with a commanded close mechanism, there are at least two possible variants:

According to a first variant, there is a single opening/closing mechanism for all the valves (8) of the perforations (5) which pass along the passage of the conveyor belt (2) and over the entire width of the conveyor belt (2) for the period of the commanded order. According to this variant, the instructions of the detection system would determine the length of each longitudinal section of the conveyor belt (2) in which the opening/closing of the valves (8) of the perforations (5) is commanded over the entire width of the conveyor belt (2);

According to a second variant, along the width are arranged both opening/closing mechanisms and longitudinal lines of perforations (5) of the conveyor belt (2) (in the direction of longitudinal travel of the conveyor belt (2)); the opening/closing mechanisms are distributed along the width dimension of the conveyor belt (2) and each mechanism houses the entire longitudinal dimension of at least one section of the journey of the conveyor belt (2), such that the opening/closing order of each one of the opening/closing mechanisms must be given and they open/close the valves (8) of all the perforations (5) arranged in each longitudinal line of perforations (5) of the conveyor belt (2) to which each specific mechanism corresponds, for the period of the commanded order.

In the case of opting for an embodiment of valves (8) with commanded opening/closing mechanism according to the second variant described above, the opening/closing of all the valves (8) of all the perforations (5) can be controlled, such that in any configuration for supplying the substrates (1) to the conveyor belt (2), completely closed suction can be maintained (always from where the area (13) ends)).

In the case of opting for an embodiment of valves (8) with commanded opening/closing mechanism according to the first variant described above, the opening/closing of "longitudinal slots" of perforations (5) can be carried out. That is to say, over the entire width of the conveyor belt (2) and for a specific length of said conveyor belt (2), all the valves (8) of the perforations (5) contained in said longitudinal slot are kept open or closed and can be kept like this until their return again to the area (13).

Figure 7:
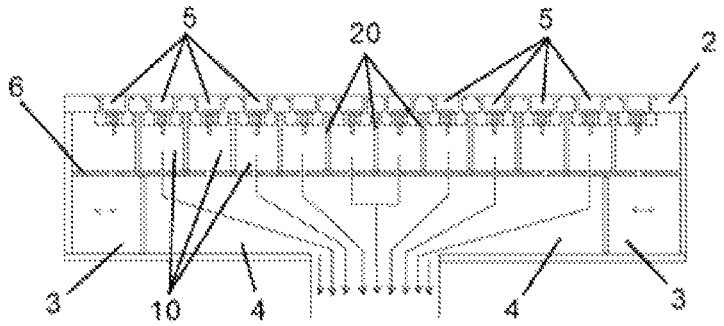
FIG. 7: Shows a transversal section of the vacuum system for securing substrates on a conveyor belt, with a width-adjustable suction channel being combined with an opening/closing mechanism for all the valves of the perforations of the entire width of the conveyor belt.
Figure 8A:
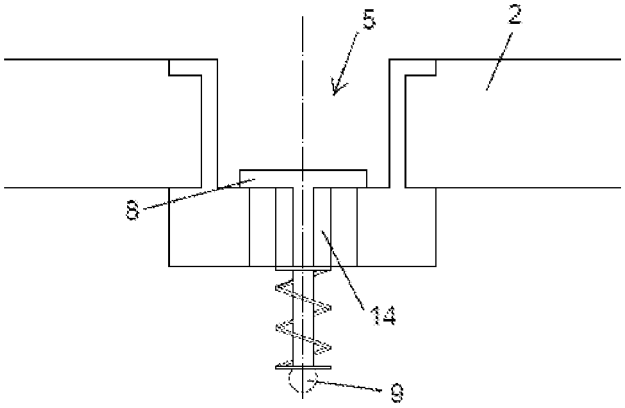
FIG. 8A: is a close-up view of certain elements in FIG. 5 showing the guide (14).
Figure 8B:
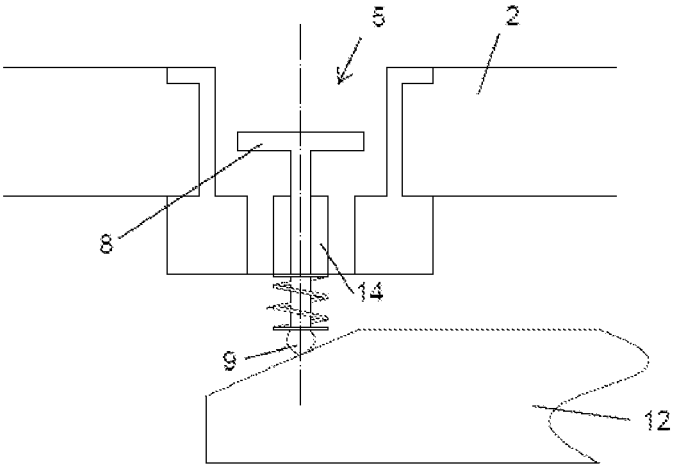
FIG. 8B: is a close-up view of certain elements in FIG. 6 showing the guide (14).

This execution according to the first variant can be complemented (see FIG. 7) with width regulating suction (with displaceable lateral plates (3)) according to the state of the art such that, with a supply of substrates (1) according to the one or double paired piece configuration, the suction in the perforations (5) between substrates (1) remains closed.

The vacuum system for securing substrates (1) on a conveyor belt (2) object of the present invention produces a series of advantages among which the following can be mentioned:

Allows continuity of the vacuum in each perforation (5) of the conveyor belt (2); consequently, uniformity of the securing force is achieved in each substrate (1) for its displacement on the conveyor belt (2);

Allows less friction of the conveyor belt (2) in its displacement since the conveyor belt (2) is not continuously "suctioned" against a perforated sheet like in conventional vacuum systems, ultimately achieving less energy consumption;

Allows "cuts" of the suction air flow continually produced in each perforation of the conveyor belt (2) to be avoided.

The invention claimed is:

1. A vacuum system for securing substrates, comprising:

a suction line, a conveyor belt configured to receive and transport at least one substrate, wherein the conveyor belt comprises a plurality of perforations, a plurality of valves corresponding to the plurality of perforations fixed to the conveyor belt such that each valve opens and closes a corresponding perforation of the conveyor belt thereby allowing and impeding, respectively, the passage of a fluid flow through the perforation, wherein the vacuum system is configured to produce fluid suction through the plurality of perforations towards an interior of the suction line, generating a securing force of the at least one substrate to the conveyor belt, wherein in an area of the conveyor belt where the suction is applied, the valve comprises a mechanism configured to allow closing of the valve when there is no substrate over the corresponding perforation, and wherein the vacuum system further comprises a valve opening device along at least one area of the suction line, wherein the opening device is configured to force an open position of the valves.

2. The vacuum system for securing substrates according to claim 1, further comprising at least one support partition to guide and support the conveyor belt in its displacement, the support partition arranged forming at least one suction chamber which connects the suction of the fluid between the conveyor belt and the suction line.

3. The vacuum system for securing substrates according to claim 2, further comprising a perforated plate arranged for the passage of the suction fluid therethrough between the conveyor belt and the suction line and, where appropriate, arranged between the suction chambers and the suction line.

4. The vacuum system for securing substrates according to claim 1, wherein the opening device is a cam configured to produce a pushing force on projections of the valves, forcing the open position of the valves.

5. The vacuum system for securing substrates according to claim 1, wherein the mechanism is an auto-close mechanism.

6. The vacuum system for securing substrates according to claim 5, wherein the configuration of the auto-close mechanism configured to allows the closing of the valve comprises a guide which allows the free movement of the valve, such that when there is no substrate arranged over the corresponding perforation, the valve is moved by the guide and is closed by the suction itself of the vacuum system.

7. The vacuum system for securing substrates according to claim 1, wherein the mechanism is a commanded close mechanism.

8. The vacuum system for securing substrates according to claim 7, further comprising a detection subsystem of the position of the at least one substrate on the conveyor belt, wherein said detection subsystem is configured to send instructions indicative of the positioning of the at least one substrate to the commanded close mechanism to close valves in a plurality of perforations on which no substrate is arranged.

9. The vacuum system for securing substrates according to claim 8, wherein the commanded close mechanism is arranged covering the entire width of the conveyor belt along at least one specific longitudinal section of the conveyor belt, such that the commanded close mechanism is configured to close all the valves in said at least one specific longitudinal section of the conveyor belt and over the entire width of the conveyor belt, before receiving instructions from the detection subsystem.

10. The vacuum system for securing substrates according to claim 8, wherein the perforations are arranged according to longitudinal alignments in a direction of travel of the conveyor belt, wherein said longitudinal alignments are distributed along a width of the conveyor belt, wherein there is an independent commanded close mechanism in correspondence with each longitudinal alignment of perforations and wherein each commanded close mechanism houses at least one longitudinal section of its corresponding longitudinal alignment of perforations.

11. The vacuum system for securing substrates according to claim 7, wherein each commanded close mechanism is configured to close valves for a predetermined time interval.

12. The vacuum system for securing substrates according to claim 7, wherein the configuration of the commanded close mechanism which allows the closing of each valve comprises at least one spring which forces an open or closed position of the valve.

13. The vacuum system for securing substrates according to claim 1, further comprising a suction width regulating subsystem which in turns comprises at least one displaceable lateral plate which laterally limits the suction line, wherein said suction width regulating subsystem is configured to adjust the width of the suction line by means of the displacement of the at least one displaceable lateral plate.

* * * * *